US005378222A

United States Patent [19]

Weber

[11] Patent Number: 5,378,222

[45] Date of Patent: Jan. 3, 1995

[54] APPARATUS FOR FOLDING SHEETS FOR INSERTION INTO AN ENVELOPE

[76] Inventor: William G. Weber, 344 Woodland Dr., Downingtown, Pa. 19335

[21] Appl. No.: 65,715

[22] Filed: May 24, 1993

[51] Int. Cl.[6] ..... B65H 45/12; B65H 45/30

[52] U.S. Cl. ..... 493/405; 493/455

[58] Field of Search ..... 493/405, 455

[56] References Cited

U.S. PATENT DOCUMENTS

| | | | |
|---|---|---|---|
| 747,085 | 12/1903 | Rieffel | 493/405 |
| 1,346,109 | 7/1920 | Astley | 493/405 |
| 1,678,917 | 5/1927 | Roush | 493/405 |
| 1,806,125 | 5/1929 | Spohn | 493/405 |
| 1,809,000 | 6/1931 | Stealy | 493/405 |
| 1,845,191 | 12/1930 | Reyer | 493/405 |
| 2,918,276 | 11/1957 | Weston | 493/405 |
| 3,092,379 | 4/1962 | Collier | 493/405 |
| 4,421,500 | 12/1983 | Smith | 493/405 |
| 4,865,579 | 9/1989 | Kirby et al. | 493/458 |
| 5,057,070 | 10/1991 | Pidcock | 493/405 |
| 5,226,872 | 7/1993 | Watson | 493/457 |
| 5,259,827 | 11/1993 | Staniszewski et al. | 493/451 |

FOREIGN PATENT DOCUMENTS

| | | | |
|---|---|---|---|
| 511648 | 11/1930 | Germany | 493/405 |
| 724212 | 8/1942 | Germany | 493/458 |
| 21338 | 2/1980 | Japan | 493/405 |

*Primary Examiner*—William E. Terrell
*Attorney, Agent, or Firm*—Michael F. Petock

[57] ABSTRACT

An apparatus is provided for folding either of two size sheets of paper, such as letter and legal size paper, for insertion into an envelope. The apparatus includes a planar base and a pair of opposed structures against which a sheet of paper to be folded may be placed for positioning of the sheet. A folding bar is mountable at one several preselected positions on the base such that the sheet to be folded passes between the folding bar and the base. Preferably, a creasing bar is provided for applying pressure to a surface of the sheet to be folded causing the sheet to be pressed tightly against the folding bar such that a crease is formed across the sheet at a preselected location corresponding to the first fold of the sheet, The base and the folding bar are provided with a detent mechanism such that the folding bar may be readily, moved to the appropriate position for creation of the initial crease and the particular size of paper to be folded. A method of folding the sheets of paper is also disclosed. The pressure applied to form the initial crease may be formed in various manners, including the application of finger pressure.

18 Claims, 3 Drawing Sheets

FIG. 6
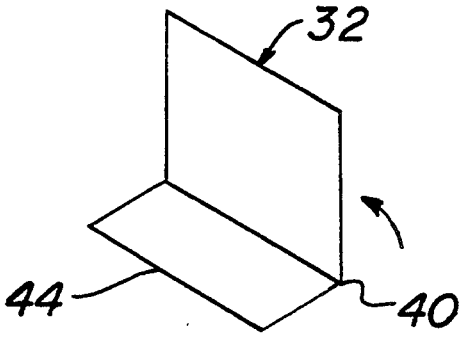
FIG. 7
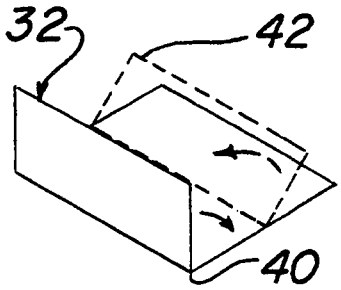
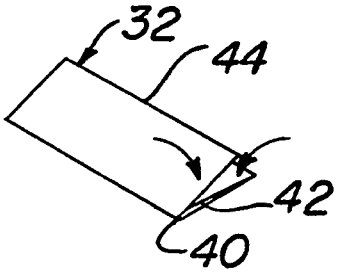
FIG. 8
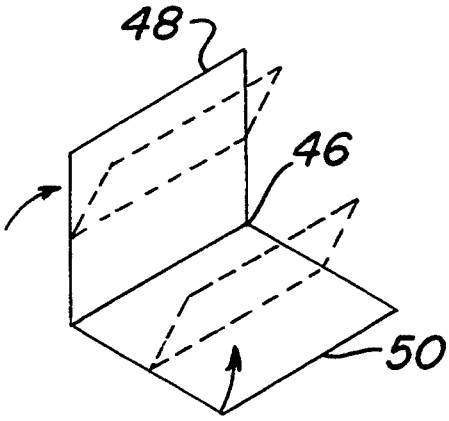
FIG. 9
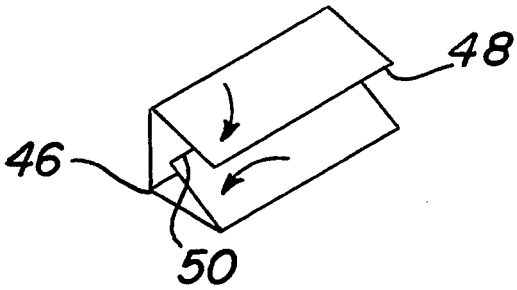
FIG. 10
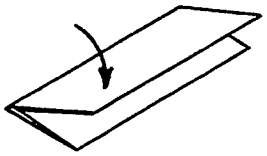
FIG. 11

APPARATUS FOR FOLDING SHEETS FOR INSERTION INTO AN ENVELOPE

BACKGROUND OF THE INVENTION

The present invention relates to an apparatus for folding sheets of paper. More particularly, the present invention relates to an apparatus for folding sheets of paper for insertion into envelopes.

U.S. Pat. No .2,918,276-Weston discloses a device for folding charts, in particular charts of random length so that they maybe inserted into a binder such that last sheet provided by the fold is a full width sheet.

U.S. Pat. No. 5,057,070-Pidcock discloses a multipurpose template for folding oversized variable linearly dimension documents wherein the template is in the form of a planar folding surface with two perpendicularly oriented alignment elements, with the planar folding surface being hung from a door.

SUMMARY OF THE INVENTION

The present invention provides an inexpensive, easy to operate, durable apparatus for the folding of sheets of paper for insertion into envelopes, such as standard business size envelopes.

The present invention provides an apparatus for the folding of sheets of paper for insertion into envelopes which is easy to use, easy to store, does not require significant space nor maintenance.

The apparatus of the present invention may be utilized for the folding of legal or letter size sheets or other standard sizes such as A4 sheets for insertion into envelopes and the apparatus may be adjusted easily and quickly for use for different size sheets.

In accordance with the present invention, an apparatus for folding sheets for insertion into an envelope is provided which comprises a planar base and a structure against which a sheet of predetermined size to be folded may be placed for positioning of the sheet. A folding bar is mountable at a preselected position on the base such that the sheet to be folded passes between the folding bar and the base. Means is provided for applying pressure to a surface of the sheet to be folded causing the sheet to be pressed tightly against the folding bar such that a crease is formed across the sheet at a preselected location corresponding to the first fold of the sheet. Preferably, the means for applying pressure to the sheet and pressing it tightly against the folding bar to cause the crease may be a creasing bar, but any other suitable means may be employed including the use of finger pressure.

In a preferred embodiment, the apparatus is provided with a second structure opposite the first structure for positioning a sheet of a second size and the planar base is provided with a plurality of detents such that the folding bar may be adjusted for the folding of either size sheet.

The present invention also includes a method of folding selected sizes of sheets of paper for insertion into an envelope, including the steps of inserting a sheet on a planar base with a folding bar adjusted to a preselected position to cause an initial crease, applying pressure to the sheet of paper juxtaposed against the folding bar and using the initial crease to complete the folding of the paper sheet by using it as a guide for at least one end of the sheet of paper.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIGS. 6, 7 and 8 are views in perspective of the folding of a letter size sheet of paper.

FIGS. 9, 10 and 11 are views in perspective of the folding of a legal size sheet of paper.

DETAILED DESCRIPTION OF THE PREFERRED EMBODIMENTS

Figure 1:
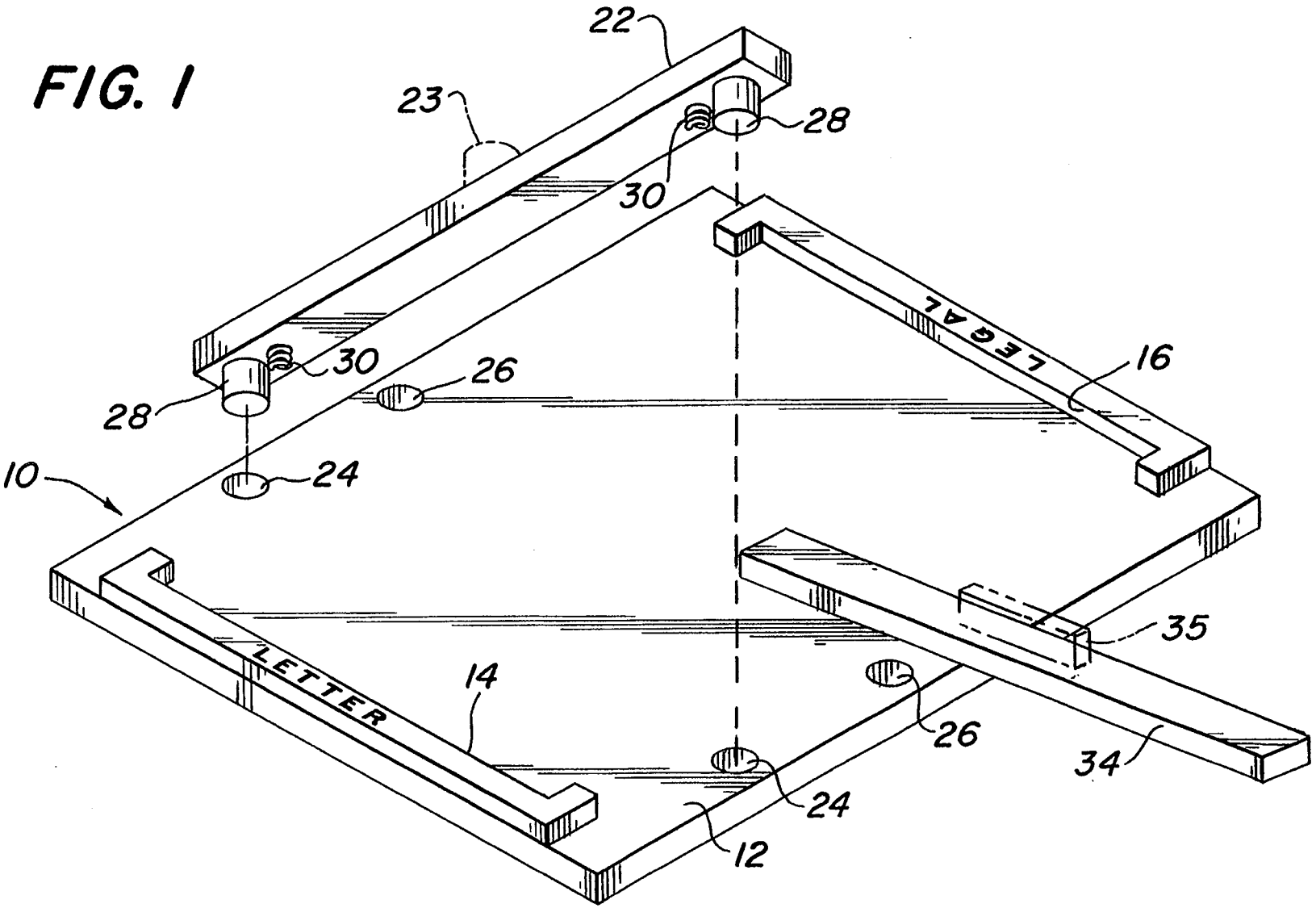
FIG. 1 is a view in perspective of a paper folding apparatus in accordance with the present invention.
Figure 2:
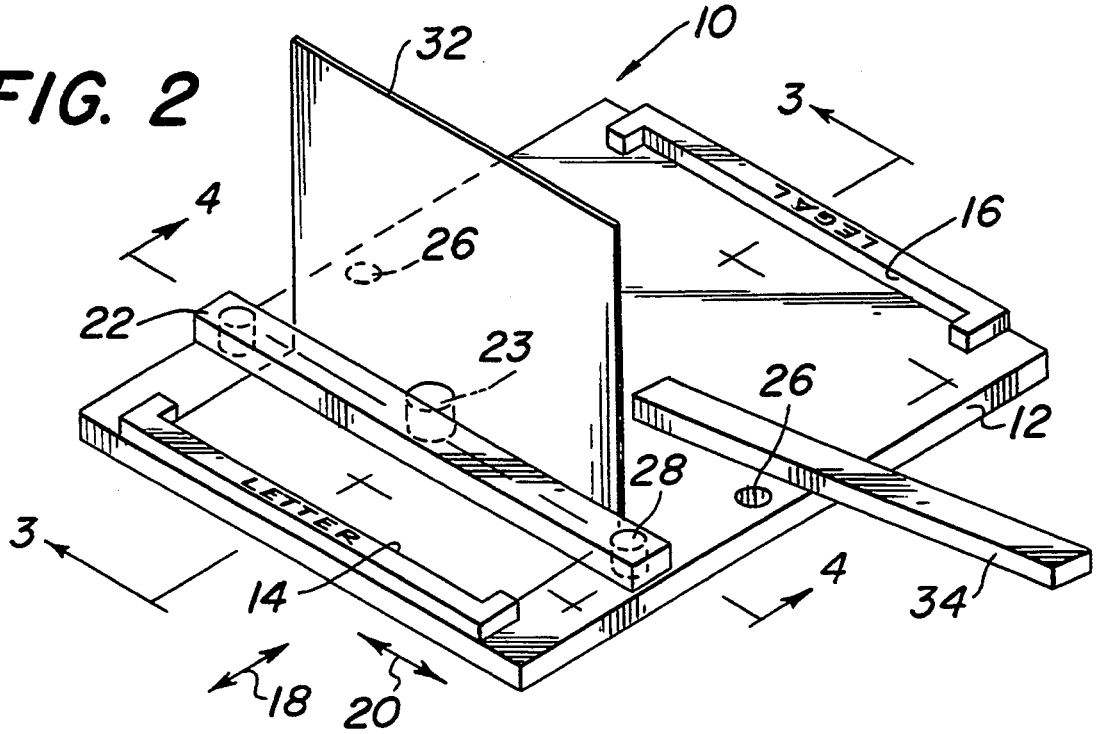
FIG. 2 is a view in perspective of a paper folding apparatus in accordance with the present invention showing a piece of paper thereon for generating the initial crease.

Referring now to the drawings wherein like numerals indicate like elements, there is shown in FIGS. 1 and 2 a paper folding apparatus 10. Paper folding apparatus 10 may be utilized to fold letter, legal or other size sheets of paper easily and accurately for insertion into standard business or other size envelopes. The presently preferred embodiment of the invention is sized or scaled for the folding of letter and legal size sheets of paper, but it is understood that the dimensions could be readily changed for the folding of other size sheets of paper, such as A4 and others. Paper folding apparatus 10 includes a planar base 12 which may be constructed of any suitable material including various plastics, woods, metals or other suitable materials.

At or near each end of the planar base, there is provided structures 14 and 16 against which a sheet of predetermined size of paper to be folded may be placed for positioning of the sheet. Structure 14, as shown in FIG. 1, is a structure against which letter size sheets of paper may be placed for positioning. Structure 16 is utilized in connection with legal size paper. The Structures 14 and 16 provide longitudinal positioning of the sheet of paper in the direction of double headed arrow 18 as well as maintaining the paper square or perpendicular with the planar base and provide positioning in the direction of double headed arrow 20. However, other suitable positioning structures may be utilized to provide these functions. For example, a plurality of pins may be provided instead of the generally "U" shaped bars 14 and 16.

A folding bar 22 is mountable at preselected positions on the base such that the sheet to be folded passes between the folding bar and the base as shown in FIG. 2. The positioning of the folding bar with respect to the base may be determined by various types of detent structure. As shown in FIGS. 1 through 5, the detent structure is in the form of holes 24 and 26. Folding bar 22 is provided with dowels or pins 28 which insert into either holes 24 or 26. Holes 24 are utilized in connection with the folding of letter size paper, and holes 26 are utilized in connection with the folding of legal size paper.

Folding bar 22 is maintained slightly spaced from the upper surface of planar base 12 by a pair of springs 30. Springs 30 maintain the spacing between base 12 and folding bar 22 for easy insertion of a sheet of paper to be creased while allowing the paper to be held firmly in place by pressing down on folding bar 22. Although a pair of coil springs 30 are illustrated in a preferred embodiment, it is understood that various other types of resilient structures may be utilized, including a leaf spring, small pieces of foam or other resilient material. Folding bar 22 optionally may be provided with a handle as shown in dotted outline form at 23.

Once the paper to be given the initial crease for folding is inserted under folding bar 22 and positioned firmly against positioning structure 14 as shown in FIG. 1, sheet 32 is creased by pressing and sliding creasing bar 34 against the back side of sheet 32 which is against folding bar 22. Creasing bar 34 optionally may be provided with a handle 36 shown in dotted outline form at 35.

Figure 3:
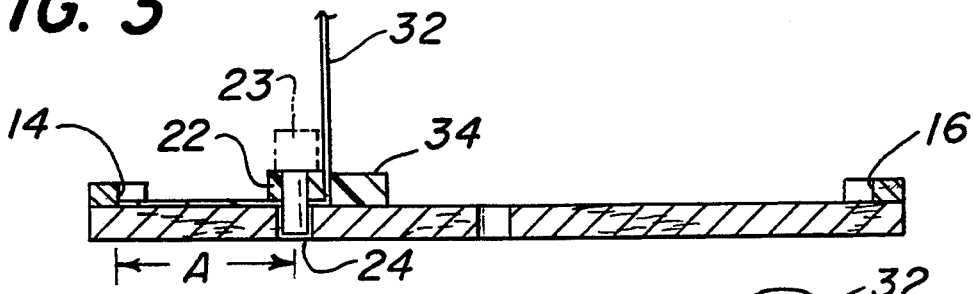
FIG. 3 is a cross-sectional view taking along line 3—3 of FIG. 2.
Figure 4:
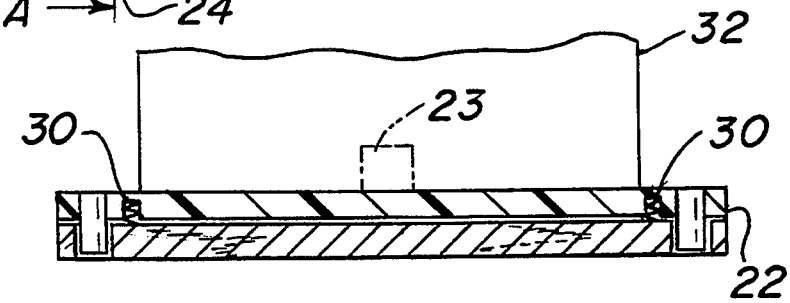
FIG. 4 is a cross-sectional view taking along line 4—4 of FIG. 2.

Side views of the creasing of a letter size sheet of paper may be best seen in FIG. 3. The creasing of a legal size sheet of paper may be best seen in side view in FIG. 5. In a presently preferred embodiment, folding bar 22 may have a width of 1". The dimension "A" shown in FIG. 3, from the positioning surface of positioning structure 14 to the center of dowel or pin 28 would be 3 3/16" producing an initial crease in the letter size paper to be folded at 3 11/16" (adding the additional ½" for the other half of the width of folding bar 22).

Figure 5:
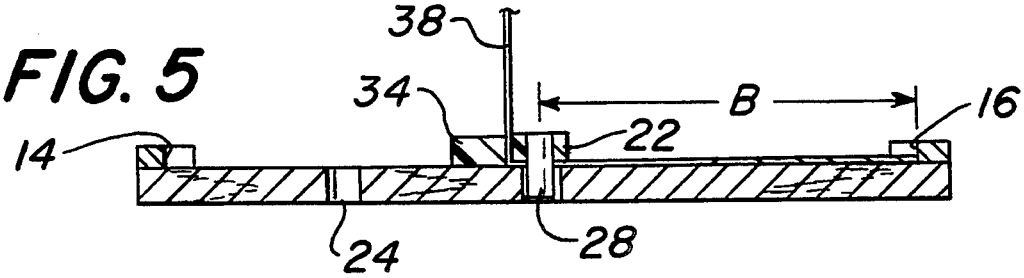
FIG. 5 is a cross-sectional view which would be taken along line 3—3, but with the folding bar adjusted for legal size paper.

In folding a legal size sheet 38 as illustrated in FIG. 5, the dimension "B" from the positioning surface of positioning structure 16 to the center of dowel or pin 28 (also the center of hole 26) would be 6½" producing an initial crease at 7" for 8½×14 paper (legal size).

Referring now to FIGS. 6, 7, and 8, there is shown a piece of letter size paper in the process of being folded utilizing the apparatus of the present invention. The letter size sheet of paper 32 is given an initial crease 40 that is 3 11/16" from one edge as illustrated and described with respect to FIGS. 2 and 3. The long side of the creased paper 32 is then folded as shown in FIGS. 7 and 8 such that the opposite end 42 of the paper is folded into crease 40, particularly as shown by the arrows in FIGS. 7 and 8. The other end 44 is then folded over to complete the folding of the sheet of paper. By utilizing the present invention, the folding of sheets of paper for insertion into business envelopes may be quickly and easily accomplished with the paper folded in a clean and professional manner each and every time. All of this is accomplished with the relatively inexpensive apparatus of the present invention.

FIGS. 9, 10 and 11 illustrate the folding of a legal size sheet of paper wherein the initial crease 46 is formed in the legal sheet of paper as illustrated in FIG. 5. The two remaining ends 48 and 50 are then folded into crease 46 as illustrated by the arrows and dotted outline forms in FIG. 9 and by the arrows and partially folded ends 48 and 50 in FIG. 10. The completion of the folding of the legal size sheet is shown in FIG. 11.

In view of the above, present invention may be embodied in other specific forms without departing from the spirit or essential attributes thereof and, accordingly, reference should be made to the appended claims, rather than to the foregoing specification as indicating the scope of the invention.

I claim:

1. An apparatus for folding sheets for insertion into an envelope, comprising:

a planar base;

a fixed structure against which a sheet of predetermined size to be folded may be placed for positioning of the sheet;

a removable folding bar mountable at preselected position spaced from said structure on said base determined by a detent located at a preselected position on said base such that the sheet to be folded passes between said folding bar and said base;

indicia on said apparatus identifying with respect to the fixed structure the size of sheet to be folded for placing in an envelope; and means for applying pressure to a surface of said sheet to be folded causing said sheet to be pressed tightly against said folding bar such that a crease is formed across said sheet at a predetermined location.

2. An apparatus for folding sheets in accordance with claim 1 wherein said means for applying pressure is a creasing bar.

3. An apparatus for folding sheets in accordance with claim 1 wherein said base member is provided with at least a second positioning structure opposite said first structure and a plurality of detents such that said folding bar may be adjusted for the folding of more than one size of sheet.

4. An apparatus for folding sheets in accordance with claim 1 further comprising springs holding said folding bar in a position spaced from said base.

5. An apparatus for folding sheets in accordance with claim 3 wherein said detents are holes in said base and said folding bar is provided with dowels which insert said holes.

6. An apparatus for folding sheets in accordance with claim 3 wherein said sheets of paper to be folded are letter size and legal size.

7. An apparatus for folding sheets in accordance with claim 3 wherein at least one of the sheets is A4 size paper.

8. An apparatus for folding sheets in accordance with claim 1 wherein said folding bar is provided with a handle.

9. An apparatus for folding sheets in accordance with claim 2 wherein said creasing bar is provided with a handle.

10. A method of folding paper for insertion into an envelope, comprising the steps of:

inserting a selected size sheet of paper to be folded for insertion into an envelope between a planar base and a removable folding bar mounted at a preselected position determined by a detent structure to cause an initial crease;

applying pressure to said sheet of paper juxtaposed against said folding bar to form an initial crease; and using the initial crease to complete the folding of the paper sheet by using it as a guide for at least one end of the sheet of paper.

11. A method of folding selected sizes of sheets of paper in accordance with claim 10 wherein said step of applying pressure to said sheet of paper juxtaposed against said folding bar is performed utilizing a creasing bar.

12. An apparatus for folding up to two preselected sizes of paper sheet for insertion into an envelope, comprising:

a planar base;

a first and second structure located on opposite sides of said planar base, one of said first and second structures being adapted for the positioning of one of said preselected sizes of sheets and the second structure being adapted for positioning of the second preselected size sheet;

marking on said apparatus to identify said first and second structures with said first and second paper sheet sizes, respectively;

a folding bar;

detent structure formed at two locations on said planar base for accepting mating structure on said folding bar for removably positioning said folding bar in one of two positions, one said position being for one preselected size sheet and the other being for the second preselected size sheet of paper;

said folding bar being provided with means for spacing a lower surface of said folding bar from said planar base to enable the passage of sheets to be folded between said folding bar and said base; and means for applying pressure to a surface of a sheet to be folded causing said sheet to be pressed tightly against said folding bar such that a crease is formed across said sheet at a predetermined location depending upon the detent positioning of said folding bar.

13. An apparatus for folding paper sheets in accordance with claim 12 wherein said means for applying pressure is a creasing bar.

14. An apparatus for folding paper sheets in accordance with claim 12 wherein said means for spacing a lower surface of said folding bar from said planar base is comprised of springs holding said folding bar in a position spaced from said base.

15. An apparatus for folding paper sheets in accordance with claim 12 wherein said detent structure is comprised of holes formed in said planar base and said mating structure on said folding bar is comprised of dowels which insert into said holes.

16. An apparatus for folding paper sheets in accordance with claim 12 wherein said two preselected sizes of paper sheets are letter size and legal size.

17. A method of folding selected sizes of sheets of paper for insertion into an envelope, comprising the steps of:

selecting one of two positioning structures located on opposite sides of a planar base for use in positioning paper of a selected size;

positioning the selected size of paper against the selected positioning structure;

positioning a folding bar in one of two detent locations on said planar base corresponding to the selected size of paper to be folded;

applying pressure to said sheet of paper juxtaposed against said folding bar as positioned in the selected detent structure; and using the initial crease to complete the folding of the paper sheet by using it as a guide for at least one end of the sheet of paper to be folded.

18. A method of folding a selected size of a sheet of paper in accordance with claim 17 wherein said step of applying pressure to said sheet of paper juxtaposed against said folding bar is performed utilizing a creasing bar.

* * * * *

UNITED STATES PATENT AND TRADEMARK OFFICE

CERTIFICATE OF CORRECTION

PATENT NO. : 5,378,222

DATED : January 3, 1995

INVENTOR(S) : William G. Weber

It is certified that error appears in the above-identified patent and that said Letters Patent is hereby corrected as shown below:

Column 1, line 13, delete "maybe", insert--may be--.

Column 3, line 38, after "6 1/2", insert --,--.

Signed and Sealed this

Twenty-fifth Day of April, 1995

*Attest:*

BRUCE LEHMAN

*Attesting Officer*

*Commissioner of Patents and Trademarks*